United States Patent [19]

Kinder

[11] 3,950,050

[45] Apr. 13, 1976

[54] GEAR DRIVEN LINKAGE FOR MOVING MEMBERS BETWEEN LIMIT POSITIONS

[76] Inventor: John W. Kinder, 944 Annette Drive, Wantagh, N.Y. 11793

[22] Filed: Dec. 2, 1974

[21] Appl. No.: 528,792

[52] U.S. Cl. ..... 312/247; 108/147; 312/306

[51] Int. Cl.[2] ..... A47B 67/02; A47B 57/06

[58] Field of Search ..... 312/247, 306, 307, 312; 108/145, 147; 5/63

[56] References Cited

UNITED STATES PATENTS

| | | | |
|---|---|---|---|
| 2,212,488 | 8/1940 | Bell | 108/147 UX |
| 3,203,670 | 8/1965 | Farris | 108/147 |
| 3,415,586 | 12/1968 | Hammond | 108/147 X |
| 3,462,772 | 8/1969 | Morrison | 108/147 X |
| 3,768,883 | 10/1973 | Kauffman | 108/147 |

*Primary Examiner*—Casmir A. Nunberg
*Attorney, Agent, or Firm*—Shenier & O'Connor

[57] ABSTRACT

Apparatus for moving an article such as a kitchen wall cabinet or the like, mounted for sliding movement on the kitchen wall, between a normal elevated position at which the cabinet top is spaced from the kitchen ceiling and at which upper spaces in the cabinet are relatively inaccessible and a lowered position at which such spaces are accessible, in which a drive mechanism disposed between the top of the cabinet and the kitchen ceiling includes a lemniscate gear which is carried by a floating shaft and which is held in operative relationship with a drive gear carried by a motor driven shaft rotatably mounted at a fixed location by means of a plurality of idler gears interconnected each with the other and with the drive gear by means of a parallel motion linkage, two arms of which provide the input to a lazy tongs type linkage, the output arms of which are connected to the cabinet adjacent to its upper end, so that a single revolution of the input shaft moves the cabinet from its elevated position to its lowered position and back to its elevated position.

13 Claims, 6 Drawing Figures

Fig 1
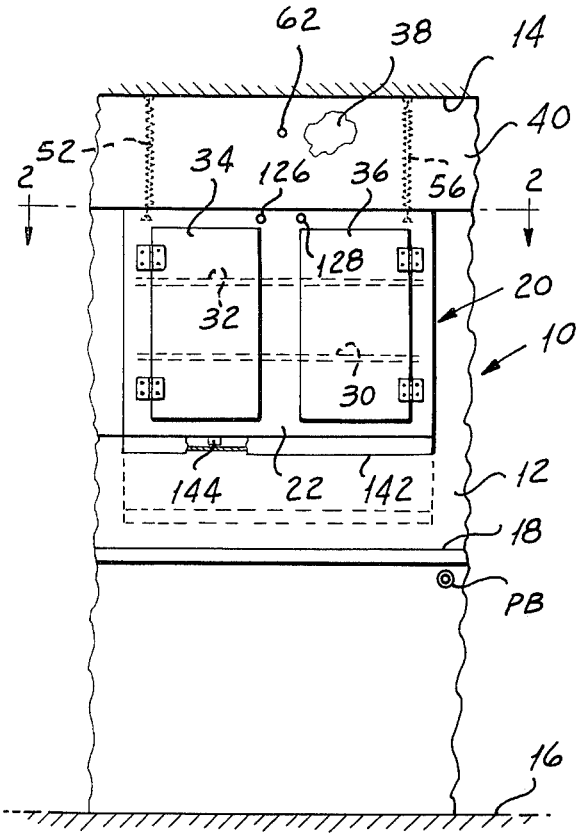
Fig 4
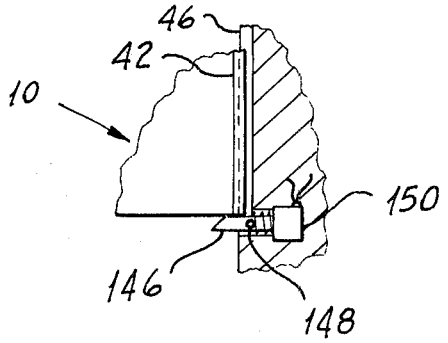
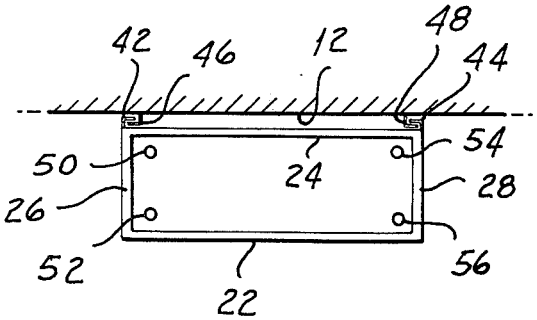
Fig 2
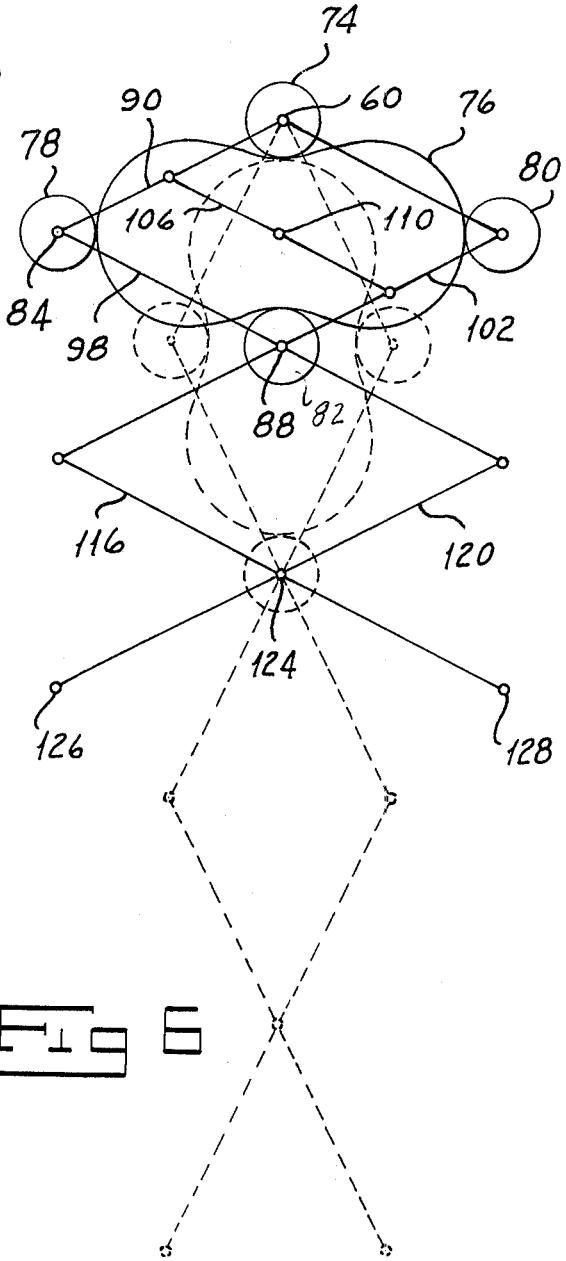
Fig 6

GEAR DRIVEN LINKAGE FOR MOVING MEMBERS BETWEEN LIMIT POSITIONS

BACKGROUND OF THE INVENTION

There are many instances in which it is desirable that an article be moved from a normal position at which portions thereof are relatively inaccessible to a position at which such portions are accessible and then be returned to its normal position. A particular example of an installation in which a member normally is so positioned that parts thereof are relatively inaccessible is a kitchen wall cabinet. As is well-known, such cabinets normally are mounted on the kitchen wall at such a height as to leave a working space between the kitchen counter surface and the bottom of the cabinet. In such an arrangement, while the lower shelves of the cabinet are relatively readily accessible, the upper shelves are not. Such being the case, the housewife is faced with the inconvenience and possible danger of standing on a stool or the like in order to gain access to the upper cabinet shelves. Further as is known in an installation of the type described, there normally exists an unused space between the top of the cabinet and the ceiling of a kitchen of normal height.

From the foregoing, it will be appreciated that it is desirable that an arrangement be provided for lowering the cabinet to a position at which the upper spaces therein are accessible and for restoring it to its normal position, so as not to interfere unduly with the working space normally provided between the bottom of the cabinet and the top of the kitchen counter. In order to achieve this result, there immediately come to mind various expedients. First, a rack and pinion drive might be provided. Alternatively, it might be possible to support the cabinet on pulleys. Both of these expedients, as well as others of which I am aware, incorporate a number of defects. First, they are relatively slow acting. Secondly, each of them requires a reversible drive motor to move the cabinet to the accessible position and to restore the cabinet to its normal position.

I have invented apparatus for automatically moving a member, such for example, as a kitchen wall cabinet or the like, between a normal position at which spaces therein are relatively inaccessible to a lowered position at which such spaces therein are relatively inaccessible to a lowered position at which such spaces are accessible. My apparatus does not require a reversible drive. My apparatus is relatively fast-acting. It is safe and certain in operation.

SUMMARY OF THE INVENTION

One object of my invention is to provide apparatus for automatically moving a member, such as a kitchen wall cabinet between an elevated position, at which regions therein are relatively inaccessible to a lowered position, at which such regions are accessible and back to its normal position.

Another object of my invention is to provide apparatus for moving a member, such as a kitchen wall cabinet between limit positions without requiring a reversible drive.

Another object of my invention is to provide apparatus for moving a kitchen wall cabinet or the like between elevated and lowered positions in a rapid and expeditious manner.

Yet another object of my invention is to provide apparatus for moving a kitchen cabinet or the like between a normal elevated position and a lowered position, which is safe and certain in operation.

Other and further objects of my invention will appear from the following description.

In general, my invention contemplates the provision of apparatus for automatically moving an article such as a kitchen wall cabinet or the like, mounted for sliding movement on the kitchen wall, between a normal elevated position at which upper regions of the cabinet are relatively inaccessible and a lowered position at which such regions are accessible, in which a lemniscate gear carried by a floating shaft is held in operative relationship with a drive gear carried by a motor driven shaft positioned at a fixed location by means of a plurality of idler gears interconnected each with the other and with the drive gear by a parallel motion linkage, two arms of which provide the input to a lazy tongstype linkage, the output arms of which are connected to the cabinet adjacent to its upper end so that a single revolution of the drive shaft moves the cabinet from its raised position to its lowered position and back again. I provide automatic means for stopping the cabinet in its lowered position and also for interrupting the drive in the event that the cabinet strikes an article on the counter or other obstruction before reaching its lower limit position.

BRIEF DESCRIPTION OF THE DRAWINGS

In the accompanying drawings to which reference is made in the instant specification and which like reference characters are used to indicate like parts in the various figures:

FIG. 1 is a front elevation of a kitchen wall cabinet installation, provided with my gear driven linkage for moving a member between limit positions.

FIG. 2 is a sectional view of the installation shown in FIG. 1, taken along the line 2—2 thereof.

FIG. 4 is a fragmentary view of the installation shown in FIG. 1, illustrating releasable means for locking the cabinet in its upper position.

FIG. 6 is a diagrammatic view of the operation of my gear driven linkage for moving a member between limit positions.

DESCRIPTION OF THE PREFERRED EMBODIMENT

Figure 5:
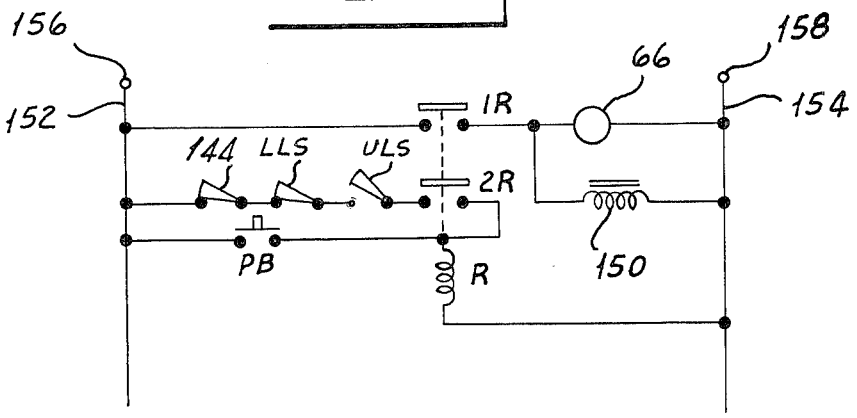
FIG. 5 is a schematic view of one form of electrical circuit which might be employed in the installation shown in FIG. 1.

Referring now to FIGS. 1 and 2, an installation indicated generally by the reference character 10 in which my apparatus is especially adapted to be used may be provided in a kitchen, having a wall 12, a ceiling 14, and a floor 16. As is known, the kitchen may be provided with a counter 18 and with a kitchen cabinet indicated generally by the reference character 20 mounted on the wall 12 above the counter 18 so as to leave a working space between the bottom of the cabinet and the top of the counter 18. Cabinet 20 includes a front 22, a back 24, and sides 26 and 28. Within the interior of the cabinet, spaced shelves 30 and 32 are adapted to support articles. The front 22 of the cabinet is provided with doors 34 and 36, adapted to be opened for access to the interior of the cabinet. The dead space 38 between the top of the cabinet and the ceiling 14 may, if desired, be covered by a front 40.

By way of example, in a typical kitchen installation, the top of the counter 18 may be three feet above the floor 16. Cabinet 20 is normally positioned so that there is approximately a foot-and-a-half between the bottom of the cabinet and the top of the counter 18. The shelves 30 and 32 may be at one foot intervals within the cabinet, which has an overall height of three feet, for example. In a typical kitchen, having a height nine feet from floor 16 to ceiling 14, there is approximately a foot-and-a-half between the top of the cabinet 20 and the ceiling 14. With such an arrangement, the bottom of the cabinet 20 is four and one-half feet above the floor 16 and the intermediate shelf 30 in the cabinet is five and one-half feet above floor level, so that both of these regions within the cabinet 20 are relatively accessible. The top shelf 32, however, is six and one-half feet above the floor so that the contents thereof are not readily accessible and cannot easily be seen by the housewife of normal height.

In applying my apparatus to an installation such as that illustrated in FIGS. 1 and 2, I provide the cabinet 20 with respective retaining guides 42 and 44, running vertically along the outer edges of the back thereof. Complementary retainer guides 46 and 48 are mounted on the wall 12 at the appropriate locations, so that the two pairs of guides 42 and 46 and 44 and 48 cooperate slidably to mount the cabinet 20 on the wall 12. Any suitable means, such for example as a plurality of tension springs 50, 52, 54, and 56, connected between the ceiling 14 and the top of the cabinet 20, adjacent to the corners thereof, may be employed to retain the cabinet 20 in its normal elevated position, at which the top front edge thereof bears against the lower edge of the front 40.

Figure 3:
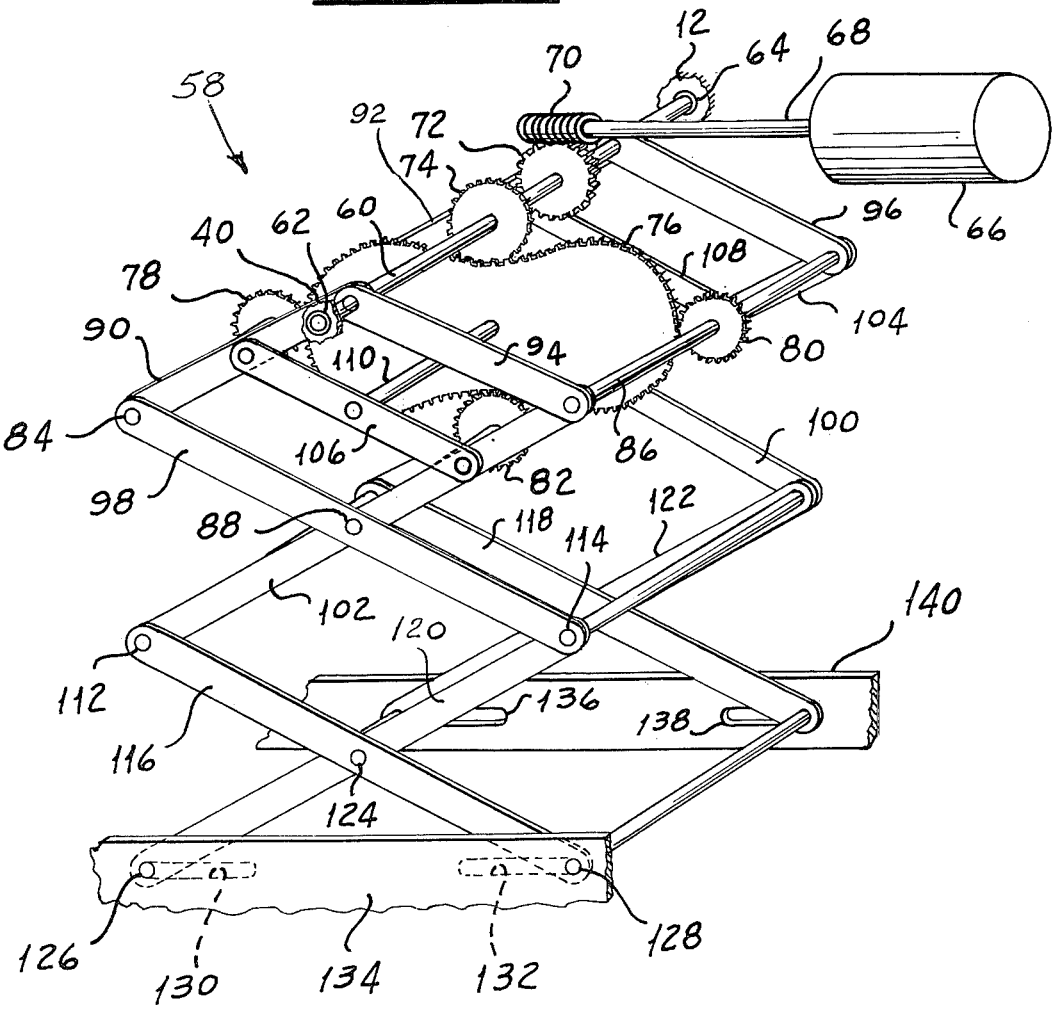
FIG. 3 is a perspective view of my gear driven linkage for moving a member between limit positions.

Referring now to FIGS. 1 and 3, my mechanism, indicated generally by the reference character 58, for moving the cabinet 20 between an elevated position at which the upper regions thereof are relatively inaccessible, to a lowered position at which the upper regions are accessible, includes a main shaft 60 rotatably supported in respective bearings 62 and 64 in the front 40 and in the wall 12. A motor 66 having a shaft 68 is adapted to be energized to rotate a worm 70 on shaft 68 to drive a gear 72 on the shaft 60 thereby to rotate the shaft. In a kitchen having a height of eight feet from floor to ceiling it may be necessary to mount the mechanism in the rafters. Such an arrangement may be desirable in any event since adequate support for the mechanism already exists at that location. Shaft 74 is held in operative relationship with a lemniscate gear 76 by a mechanism to be described. The shape of the gear 76 is derived from the general expression:

$$(1) \quad (x^2 + y^2)^2 = a^2x^2 + y^2b^2$$

where $a$ equals the minor radius and $b$ equals the major radius of the curve. Respective idler gears 78, 80 and 82, which engage the lemniscate gear 76, are carried by respective shafts 84, 86 and 88. A first pair of links 90 and 92 connect shaft 60 to the shaft 84. A second pair of connecting links 94 and 96 connect shaft 60 to the shaft 68. The upper halves of a pair of scissor linkage arms 98 and 100 interconnect the idler shaft 88 with the idler shaft 84. The upper halves of a second pair of scissors links 102 and 104 connect shaft 86 to the shaft 86. I provide respective parallel motion links 106 and 108 for interconnecting the midpoints of links 90 and 92 with the midpoints of the upper halves of the scissors arms 102 and 104. A shaft 110 which supports the lemniscate gear 76 is supported by the links 106 and 108 at locations midway between the ends of the links. It will be appreciated from the structure just described that I have provided a parallel motion linkage for holding the lemniscate gear 76 in operative relationship with the drive gear 74. More specifically in connection with the shape of the gear 76 the coordinate of the curve can be determined from the following expressions derived from equation (1) above:

$$(2) \quad X = x \pm dy'[1+(y')^2]^{-1/2}$$

and $$(3) \quad Y = y \pm d[1+(y')^2]^{1/2}$$

where $d$ is the radius of each of the gears 78, 80 and 82 and $y'$ *is the first derivative of* $y$ from equation (1). With my arrangement as gear 76 goes through a revolution the center of each of the links 90, 92, 94 and 96 as well as the center of the upper half of each of the links 98, 100, 102 and 104 describes a path in accordance with equation (1). Thus it will be seen that while gear 76 is not a true lemniscate in shape its outline configuration is derived from the expression for a lemniscate so that it may be termed "leminscatic" in form.

An elongated pin or rod 112 connects the lower ends of the arms 102 and 104, each to the other and respectively to the upper ends of scissors arms 116 and 118. Another elongated pin or rod 114 connects the lower ends of the arms 98 and 100, each to the other and to the upper ends of scissors arms 120 and 122. A pin 124 pivotally connects arms 116 and 120 adjacent to the midpoints thereof and connects arms 118 and 122 adjacent to the midpoints thereof. Respective rods 126 and 128 connect the lower ends of arms 120 and 122 to the top of the cabinet 20 and connect the lower ends of arms 116 and 118 to the top of the cabinet. In order to accommodate the lateral movement of rods 126 and 128, the front ends thereof ride in slots 130 and 132 formed in an upward extension of the cabinet front 22. Similarly, the rear ends of the rods 126 and 128 ride in slots 136 and 138 formed in an upward extension 140 of the cabinet back 24.

From the structures just described, it will readily be appreciated that arms 98, 100, 102, 104, 116, 118, 120 and 122 form a "lazy tongs" linkage.

When motor 66 is energized in a manner to be described, the mechanism 58 moves cabinet 20 against the action of the springs 50, 52, 54 and 56 from an elevated position, illustrated in full lines in FIG. 1, to a lowered position, indicated in dot-dash lines in the figure, at which the bottom of the cabinet is adjacent to the counter top 18. I provide the cabinet 20 with means for arresting its downward movement in the event that it may strike an object on the counter top 18, or any other obstruction in its path of movement. To achieve this result, I may provide the cabinet with a false bottom 142 adapted to move upwardly when it strikes an object. Such upward movement may, for example, actuate a switch 144 to interrupt the cabinet drive in a manner to be described.

Further, it may be desirable to provide some means for releasably retaining the cabinet in its upper position. For this purpose, I may provide a catch 146 normally biased by a spring 148 to a position under the cabinet 20. A solenoid 150 may be energized to withdraw the catch 146 against the action of spring 148 to permit the cabinet to move downward.

Referring now to FIG. 5, one form of electrical circuit, which may be employed to control the movement of the cabinet 20 includes respective conductors 152 and 154 connected to the terminals 156 and 158 of a suitable source of electrical energy. I connect the motor 66 in series with normally open relay switch 1R between conductors 152 and 154. A push-button switch PB, which may be located just below counter top 18 is adapted to be actuated to close the switch to energize a relay winding R connected in series with the push-button switch PB between conductors 152 and 154. When energized, winding R closes switch 1R and a switch 2R connected between relay winding R and conductor 152 in series with the stop switch 144, a lower limit switch LLS and normally open upper limit switch ULS. The switches LLS and ULS may be suitably located on the wall 12 at positions at which they are actuated by appropriate means on the cabinet 20. Alternatively power may be supplied to the motor through brushes on the cabinet in sliding engagement with conductive members such as the rails 46 and 48. In such an arrangement one rail would be shorter than the other at each end so that it would cooperate with the associated brush to perform the functions of the limit switches LLS and ULS.

In operation of my mechanism for raising and lowering an object such as the cabinet 20 from an elevated position at which the upper regions thereof are relatively inaccessible to a lowered position at which such regions are accessible, the operator actuates the push-button PB to energize relay winding R to close switches 1R and 2R. The push-button PB is held actuated until cabinet 20 moves a sufficient distance from its upper position to permit switch ULS to close. When that occurs, the holding circuit for winding R is complete. Further upon the closing of switch 1R, solenoid 150 is energized to withdraw the catch 146. With the motor 66 energized, drive gear 74 rotates to drive the lemniscate gear 76 around the axis of shaft 110. In the course of this movement, shaft 110 moves downwardly through a distance equal to the distance between the major and minor radii of the gear. At the same time, the linkage is extended so that rods 126 and 128 move downwardly to an appreciable distance. I have indicated the full extent of the mechanism in broken lines in FIG. 4. When the cabinet 20 reaches its lower limit position, the switch LLS opens to deenergize relay winding R.

When the operator wishes to restore the cabinet to its upper elevated position, the push-button PB is again actuated to energize the relay winding R for a sufficient time to permit switch LLS to close. Shaft 60 rotates in the same direction to drive the gear 76 in the same direction as that in which it moved to lower the cabinet 10. The lazy tongs linkage contracts and the cabinet 20 moves to its upper limit position to open switch ULS to interrupt the holding circuit of winding R. If at any time in the course of its downward movement the cabinet engages an article on shelf 18, false bottom 142 actuates switch 144 to interrupt the holding circuit of relay winding R. The interfering object is removed and push-button PB is again operated to move the cabinet to its lowered position.

While I have shown and described my drive mechanism in an installation in which a kitchen wall cabinet is to be lowered and raised and for which use it is eminently suited, it will readily be appreciated that it is of general application and may be used in any instance in which an article is to be raised and lowered between limit positions.

It will be seen that I have accomplished the objects of my invention. I have provided apparatus for moving an article such as a kitchen wall cabinet, or the like, from an elevated position, at which areas thereof are relatively inaccessible to a lowered position, at which such areas are accessible. My arrangement does not require a reversible motor. It is rapid and expeditious in operation. It is safe and reliable.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for moving an article between a first position and a second position including in combination, a support, means mounting said article on said support for sliding movement between said positions, a lazy tongs linkage, means connecting said linkage at one end thereof to said article, said linkage being actuatable between a retracted position corresponding to the first position of said article and an extended position corresponding to the second position of said article, a drive shaft mounted for rotary movement on said support, and means responsive to a single revolution of said shaft in a given direction for positively actuating said linkage from said retracted position to said extended position and back to said retracted position to move said article from said first position to said second position and back to said first position.

2. Apparatus as in claim 1 in which said means responsive to said shaft revolution includes a lemniscatic member, and means coupling said lemniscatic member to said linkage.

3. Apparatus as in claim 2 in which said means coupling said lemniscatic member to said linkage comprises a parallel motion linkage.

4. Apparatus as in claim 3 in which said lemniscatic member is a gear.

5. Apparatus as in claim 4 in which said means responsive to said shaft revolution includes a drive gear carried by said shaft, said drive gear being in engagement with said lemniscatic gear.

6. Apparatus as in claim 5 in which said means responsive to said shaft revolution comprises a plurality of idler gears and in which said parallel motion linkage connects said idler gears and said drive gear.

7. Apparatus as in claim 6 including a shaft supporting said lemniscatic gear and means connecting said shaft to said parallel motion linkage.

8. A wall cabinet installation for a room having a wall and a floor and a ceiling including in combination a cabinet, means mounting said cabinet on said wall for sliding movement between an upper limit position at which the tope of the cabinet is adjacent to said ceiling and a lower limit position at which upper regions in said cabinet are accessible, a shaft mounted for rotary movement in the space between the top of said cabinet and said ceiling and means responsive to a single revolution of said shaft in a given direction for positively moving said cabinet from said upper limit position to said lower limit position and back to said upper limit position.

9. An installation as in claim 8 including means adapted to be energized to drive said shaft, and means responsive to engagement of said cabinet with an obstruction in the course of its movement downwardly from said upper position to said lower position for deenergizing said drive means.

10. An installation as in claim 8 in which said means responsive to said shaft revolution comprises a lazy tongs linkage and means coupling said linkage to said shaft.

11. An installation as in claim 10 in which said means coupling said linkage to said shaft includes a member of lemniscatic configuration.

12. An installation as in claim 11 in which said means coupling said linkage to said shaft comprises a drive member on said shaft for driving said lemniscatic member and means for holding said lemniscatic member in operative relation with said drive member.

13. An installation as in claim 12 in which said means for holding said lemniscatic member in operative relationship with said drive member comprises a plurality of idler members and a parallel motion linkage connecting said idler members and said drive members.

* * * * *